US010246814B2

(12) United States Patent
Maejima

(10) Patent No.: US 10,246,814 B2
(45) Date of Patent: Apr. 2, 2019

(54) BUFFERING DEVICE IN AUTOMATIC CLOTH FEEDER

(71) Applicant: TOTOFOLDER MANUFACTURING CO., LTD., Kawaguchi-shi, Saitama (JP)

(72) Inventor: Yozo Maejima, Kawaguchi (JP)

(73) Assignee: TOTOFOLDER MANUFACTURING CO., LTD., Kawaguchi-Shi, Saitama (JP)

( * ) Notice: Subject to any disclaimer, the term of this patent is extended or adjusted under 35 U.S.C. 154(b) by 66 days.

(21) Appl. No.: 15/525,619

(22) PCT Filed: Apr. 17, 2015

(86) PCT No.: PCT/JP2015/061842
§ 371 (c)(1),
(2) Date: May 10, 2017

(87) PCT Pub. No.: WO2016/084401
PCT Pub. Date: Jun. 2, 2016

(65) Prior Publication Data

US 2017/0335505 A1 Nov. 23, 2017

(30) Foreign Application Priority Data

Nov. 25, 2014 (JP) ..... 2014-237821

(51) Int. Cl.
*D06F 67/04* (2006.01)

(52) U.S. Cl.
CPC ..... *D06F 67/04* (2013.01)

(58) Field of Classification Search
CPC ..... D06F 67/00; D06F 67/04; D06F 69/00; D06F 69/02
See application file for complete search history.

(56) References Cited

U.S. PATENT DOCUMENTS 3,911,604 A * 10/1975 Sjostrom ..... D06F 67/04 38/143
4,327,510 A * 5/1982 Grantham ..... D06F 67/04 223/37

(Continued)

FOREIGN PATENT DOCUMENTS

JP 62-211100 A 9/1987
JP 2-152500 A 6/1990

(Continued)

OTHER PUBLICATIONS

International Search Report, dated Jul. 7, 2015 (2 pages).

*Primary Examiner* — Ismael Izaguirre
(74) *Attorney, Agent, or Firm* — Jacobson Holman, PLLC.

(57) ABSTRACT

A buffering device in an automatic cloth feeder that includes a cloth standby section which accumulates the cloth. There is provided a cloth supply section 11 that can supply a quantity of cloth exceeding a processing quantity of feeding so as to proceed with feeding in an automatic cloth feeder without congestion in the automatic cloth feeder performing a process in which the cloth is introduced to a feeding conveyor at a substantially central portion in a carrying direction, right and left trailing end portions are altered by crumpling the cloth from the right and left sides, the cloth is held in a deposition section, and the cloth is fed into a process. A cloth standby section 14 in which the cloth to be carried stands by temporarily is set at a preceding stage of a feeding conveyor 20 or at a following stage thereof.

3 Claims, 10 Drawing Sheets

(56) References Cited

U.S. PATENT DOCUMENTS

| | | | | | |
|---|---|---|---|---|---|
| 4,979,868 | A * | 12/1990 | Ueda | B61B 10/025 | 38/12 |
| 5,169,282 | A * | 12/1992 | Ueda | D06F 67/04 | 38/7 |
| 5,440,810 | A * | 8/1995 | Borucki | D06F 67/04 | 38/143 |
| 5,515,627 | A * | 5/1996 | McCabe | D06F 67/04 | 38/143 |
| 5,606,812 | A * | 3/1997 | Jensen | D06F 67/04 | 26/87 |
| 6,584,711 | B1 * | 7/2003 | Nakamura | D06F 67/04 | 38/143 |
| 8,028,444 | B2 * | 10/2011 | Heinz | D06F 95/00 | 38/143 |
| 8,732,995 | B2 * | 5/2014 | Herzog | D06F 67/04 | 38/143 |

FOREIGN PATENT DOCUMENTS

| | | | |
|---|---|---|---|
| JP | 3-18400 | A | 1/1991 |
| JP | 4-158899 | A | 6/1992 |
| JP | 10-550 | A | 1/1998 |
| JP | 11-114296 | A | 4/1999 |
| JP | 2004-89473 | A | 3/2004 |
| JP | 2004-162217 | | 6/2004 |
| JP | 2007-92255 | A | 4/2007 |
| JP | 2010-110574 | A | 5/2010 |
| JP | 2011-30743 | A | 2/2011 |
| JP | 2011-36312 | A | 2/2011 |

* cited by examiner

BUFFERING DEVICE IN AUTOMATIC CLOTH FEEDER

BACKGROUND OF THE INVENTION

The present invention relates to a buffering device in an automatic cloth feeder in which cloth is introduced to a feeding conveyor at a substantially central portion in a carrying direction, right and left trailing end portions thereof are detected by crumpling the cloth from the right and left, and the right and left trailing end portions are held by a deposition section.

As linen products handled in the so-called linen supply industry, there are bed sheets, bed covers, large and small towels, other various types of cloth, and clothing such as gowns. The cloth collected from a customer is repeatedly subjected to a process of washing, ironing, and folding, before being delivered to the customer. The cloth is fed into the process by a feeder. However, in an automated feeding process, when the cloth is placed on a feeding conveyor, a particular portion is held by a member on the feeder side while being carried, and then, the cloth is automatically spread. The spread cloth is fed onto a carrying conveyor from leading end portions. Accordingly, the cloth can be carried into the ironing process in a spread state, for example.

An automatic feeding method is divided into two main types of methods. One is a method in which one end or both ends of cloth are searched for so as to be fed, and the other one is a method in which both ends of cloth are automatically searched for and are automatically spread when a side of the cloth is fed onto the carrying conveyor. Presently, the main stream is the former method because the latter method has low stability and quality. However, according to the studies carried out by the inventor, it is difficult to say that the former method is absolutely advantageous. The latter method rather has room for improvement, achieving a prospect of being superior to the former method when improved. As the latter method, there is the invention disclosed in JP-A-10-5500.

As the automatic feeding method is employed, working efficiency per worker is improved, and production volume per feeding station is increased. Thus, by adopting the two-station feeding process, it is possible to exhibit the maximum capacity of a straightening unit for straightening cloth. Meanwhile, balance cannot be maintained with respect to a supply amount from the feeding station, and a delay of feeding has become a problem. It is preferable to be able to increase the number of cloth pieces which can be accumulated from the feeding station to the straightening unit, but there is no room for an increase in the existing device. The delay of feeding leads directly to a problem of reduced production volume. When a delay occurs once, it is extremely difficult to recover after the delay.

PRIOR ART

Patent Document 1: JP-A-10-5500

BRIEF DESCRIPTION OF THE INVENTION

The present invention has been made taking the foregoing circumstances into consideration. An object thereof is to provide a buffering device in an automatic cloth feeder including a cloth standby section in which cloth stands by temporarily, and allowing the cloth to be accumulated. Another object of the present invention is to provide a cloth spreading device in which the cloth standby section can be arranged either before or after a feeding conveyor and a deposition section, and the number of cloth pieces to be accumulated can be increased and decreased.

In order to solve the above-mentioned problems, the present invention includes a cloth supply section that can supply a quantity of cloth exceeding a processing quantity of feeding so as to proceed with feeding in an automatic cloth feeder without congestion in the automatic cloth feeder in which the cloth is introduced to a feeding conveyor at a substantially central portion, right and left trailing end portions of the cloth are detected by crumpling the cloth from the right and left, and the right and left trailing end portions are held in a deposition section. Means for setting a cloth standby section in which the cloth to be carried stands by temporarily at a preceding stage of the feeding conveyor or at a following stage thereof is devised. The central portion of cloth denotes a central portion of cloth to be carried in a movement direction. Cloth is considered as the workpiece in the device of the present invention. However, it is possible that the cloth includes clothing as well.

The automatic cloth feeder applied with the buffering device of the present invention adopts a method in which a side of cloth is fed onto the carrying conveyor and both ends of cloth are automatically searched for and are automatically spread. When the cloth is introduced to the feeding conveyor at the substantially central portion in the carrying direction and is carried to a predetermined position on the front face of the feeder main body, both the right and left portions of cloth are crumpled in a central portion direction of the cloth, thereby performing deposition from the right and left trailing end portions of the cloth. As the cloth is introduced to the feeding conveyor at the substantially central portion and is carried to a predetermined position on the front face of the feeder main body, both the right and left portions of the cloth drooping on the right and left sides of the feeding conveyor are crumpled and in the central portion direction of the cloth, and the right and left trailing end portions are held by a member provided on the feeder side.

In such a configuration, according to the device of the present invention, means for arranging the cloth standby section in which the cloth to be carried stands by temporarily at the preceding stage of the feeding conveyor or at the following stage. The cloth supply section is a means for supplying the cloth to perform automatic feeding. Therefore, the cloth supply section itself can also be the cloth standby section. The cloth standby section causes the cloth to stand by temporarily without congesting feeding of the cloth which flows at a substantially regular speed and is a buffering means and a type of retention means. Having the feeding conveyor as a focal point, the cloth standby section can be arranged at the preceding stage or the following stage, or at both the preceding stage and the following stage at the same time.

The cloth standby section, a configuration in which cloth is held at the substantially central portion between the right and left sides in the movement direction and the cloth supply section equipped with clamps moving upward to the feeding conveyor from below is arranged at the preceding stage of the feeding conveyor is one of the desirable configurations. This is a method of newly providing new buffering means, that is, the so-called cloth supply section in a process of carrying cloth, thereby realizing buffering in a relatively easy manner.

In addition, the straightening unit can be provided at the following stage of the feeding conveyor in order to pull cloth held in the deposition section to the right and left sides so as to achieve a straightened state, and the straightening unit can be arranged at a plurality of places so as to function as the cloth standby section. When the straightening unit is provided at one place on the front face of the feeder, the straightening unit is also provided on the right and left sides, thereby easily realizing buffering.

Moreover, it is preferable to have a configuration in which the cloth standby section includes the circulation carrying device and a circulation route is equipped with multiple clamps for holding cloth at the substantially central portion between the right and left sides in the movement direction. On account of such a configuration equipped with the multiple clamps so as to perform circulation, only the attaching of cloth can be independently performed with respect to the clamp, being separated from an operation of the feeder. Thus, it is possible to establish a stable system having high productivity. The clamp in this method is common to the configuration described in the second previous section in that the clamp is equipped with a portion which moves upward to the feeding conveyor from below.

According to the present invention which is configured and operates as described above, a cloth standby section in which cloth stands by temporarily is provided so as to accumulate the cloth, thereby preventing a delay of feeding. As a result, it is possible to exhibit an effect in that a stable system having high productivity can be established. In addition, according to the present invention, it is possible to provide a buffering device in an automatic cloth feeder in which the cloth standby section can be arranged either before or after a feeding conveyor and the number of cloth pieces to be accumulated can be arbitrarily increased and decreased.

BRIEF DESCRIPTION OF THE DRAWINGS

FIG. 3 consists of 3A, 3B and illustrates an enlarged main portion of a buffering device in the automatic feeder, similarly.

FIG. 9 consists of 9A, 9B, 9C and illustrates a process of feeding cloth.

DESCRIPTION OF REFERENCE NUMERALS AND SIGNS

10 AUTOMATIC CLOTH FEEDER
11 CLOTH SUPPLY SECTION
12 CLAMP
13 MOVEMENT MECHANISM
14 CLOTH STANDBY SECTION
15 TRAILING END SEPARATION MECHANISM
16 TRAILING END GUIDANCE FRAME
17 LEADING END COVER
19 LOWER CONVEYOR
20 FEEDING CONVEYOR
21 UPPER CONVEYOR
22, 34, 36, 40 DRIVE UNIT
23, 24 GUIDE MEMBER
25, 26 CRUMPLING PATH
27, 28 SENSOR
30 DEPOSITION SECTION
31, 32 PAIR OF ROLLS
33 CATCH MEMBER
37, 38 SPREADING MEMBER
39 LIFTING MEANS
41 DEPOSITION MEMBER
42 CARRYING CONVEYOR
44 GUIDE RAIL
45 STRAIGHTENING UNIT
46, 47 CIRCULATION CONVEYOR
48 CONVEYOR BELT
49 DEDICATED PORTION FOR BUFFERING
50 CIRCULATION CARRYING DEVICE

Figure 1:
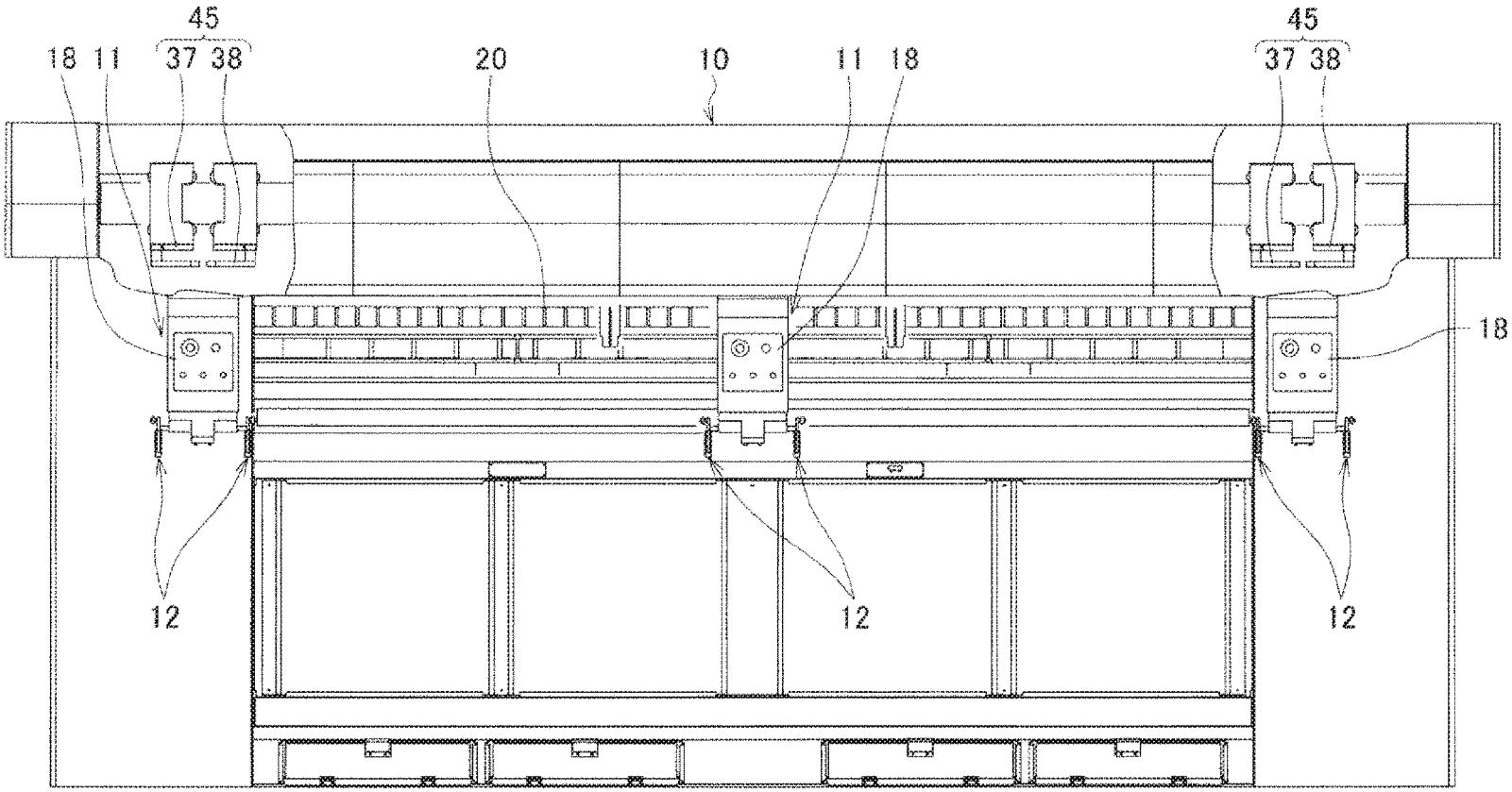
FIG. 1 is a front view illustrating an example of an automatic cloth feeder to which a buffering device according to the present invention is applied.
Figure 2:
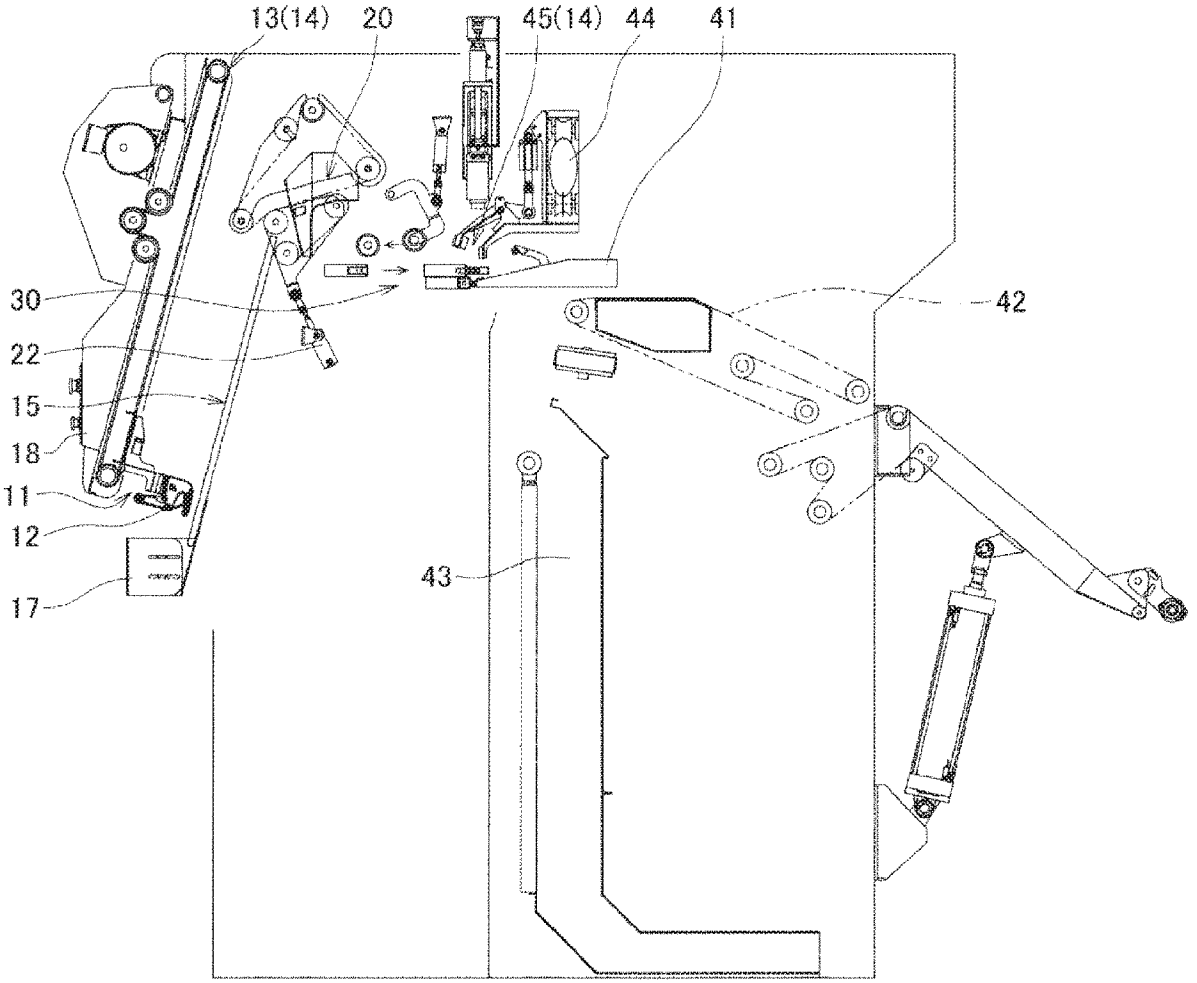
FIG. 2 is a side view illustrating the same automatic feeder.

Hereinafter, the present invention will be described in more detail with reference to an illustrated embodiment. FIGS. 1 and 2 illustrate an automatic cloth feeder 10 to which a buffering device according to the present invention is applied. On the front face of a feeder main body, a cloth supply section 11 which is equipped with a clamp 12 for holding cloth at its substantially central portion in a movement direction and moving upward toward a feeding conveyor 20 and is arranged at a position corresponding to a front portion of the feeding conveyor 20.

The cloth supply section 11 is arranged at three places, at the center and on the right and left sides on the front face of the feeder main body, and movement mechanisms 13 are respectively provided therein. The illustrated movement mechanism 13, see FIGS. 3A and 3B, includes a belt 13*c* wound around between upper and lower rollers 13*a* and 13*b* which are respectively equipped with a pair of the clamps 12 on the right and left sides. Each clamp 12 is attached to the belt 13*c* thereof, and moves upward and downward between a lower position which is closer to a worker so as to be easily attached and a higher position which is higher than a feeding port 20*a* of the feeding conveyor 20.

The pair of the clamps 12 and 12 on the right and left sides fixes cloth at the substantially central portion in the movement direction. Each clamp 12 may be a known clamp for pinching cloth and moves from the higher position closer to a worker to the higher position closer to the feeding conveyor 20 due to the aforementioned movement configuration (refer to FIGS. 2 and 3). Cloth is attached to the pair of the clamps 12 and 12 on the right and left sides by the worker so as to cause the portion of the cloth between the pair of the clamps to be as horizontal or linear as possible. The movement mechanism 13 does not repeat to move upward and downward in an example of the embodiment described below, but the clamps 12 move from the lower position to the higher position as a part of the movement which circulates a regular route.

The clamps 12 and the movement mechanism 13 hold the cloth at the substantially central portion between the right and left sides in the movement direction and configure the cloth supply section 11 equipped with the clamp 12 which moves upward towards the feeding conveyor 20 from below. In addition, in the embodiment, the cloth supply section 11 configures a cloth standby section 14 in which cloth to be simultaneously carried stands by temporarily. Particularly, the cloth standby section 14 corresponds to the cloth standby section 14 which is arranged at a preceding stage of the feeding conveyor 20.

A trailing end separation mechanism 15 for cloth is provided so as to be parallel to the cloth supply section 11. The trailing end separation mechanism 15 includes a trailing end guidance frame 16, see FIG. 3B, which is formed to have a narrow width at the lower portion and to have a wide width at the upper portion, and a leading end cover 17 provided on a leading end side which is formed to have a narrow width. In the leading end cover 17, see FIG. 3A, a central portion 17*a* protrudes outward so as to come into contact with the central portion of cloth to be carried, and the right and left trailing end portions are provided so as to be easily separated to the right and left. The reference numeral 18 indicates an operation unit. The trailing end separation mechanism 15 helps the trailing end portion of cloth be unerringly separated to the right and left sides even though the below-mentioned feeding conveyor 20 has a short carrying distance.

Figure 3A:
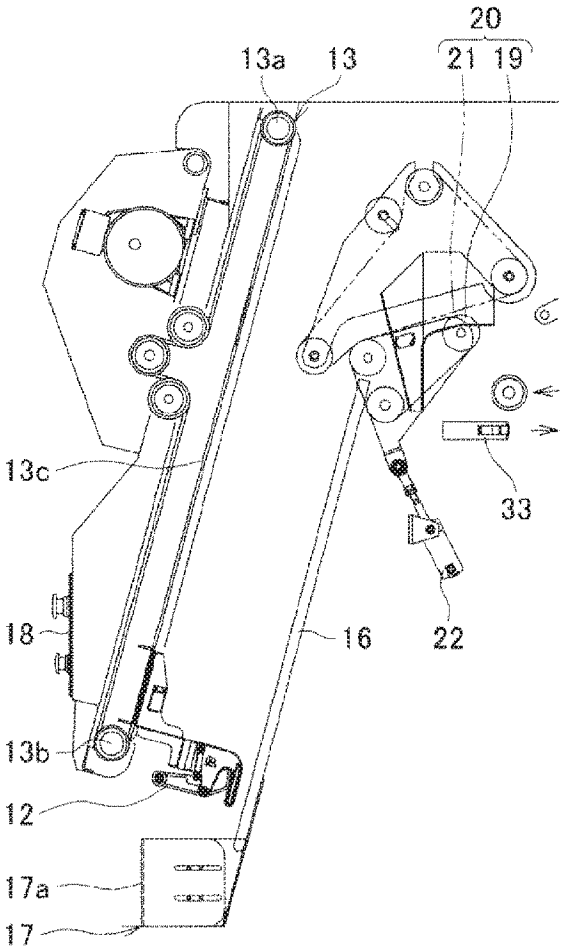
FIG. 3A is a side view.
Figure 3B:
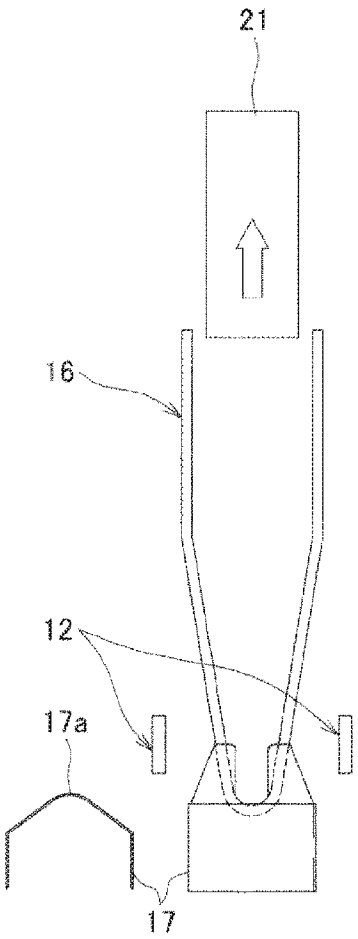
FIG. 3B is a front view illustrating a separation mechanism at a trailing end of the cloth.

In the illustrated feeder main body, the feeding conveyor 20 is arranged at an upper portion of the trailing end separation mechanism 15, and the feeding conveyor 20 is formed with a lower conveyor 19 and an upper conveyor 21, see FIG. 3A. The feeding conveyor 20 is arranged so as to be orthogonal to the front face of the feeder main body, and each one is arranged at three places in total behind the cloth supply section 11 (FIGS. 1 and 2). Since the feeding conveyor 20 is formed to be short in the cloth movement direction as described before, the trailing end portion of cloth tends to be difficult to separate to the right and left sides compared to a conveyor which is long in the cloth movement direction. In contrast, the trailing end separation mechanism 15 supplements the tendency and contributes to overall miniaturization.

The lower conveyor 19 is supported upward in its entirety by a pressing mechanism 22 formed with a cylinder device and has a structure in which contact pressure with respect to the upper conveyor 21 is adjustable. The feeding conveyor 20 includes the feeding port 20*a* which is obliquely downward in accordance with a track of the movement mechanism 13 and is provided so as to be able to feed the approaching cloth carried by the clamp 12, with no difficulty. The upper conveyor 21 is formed with a belt conveyor and is arranged obliquely upward from below so as to be low on a side closer to the feeding port 20*a* and high on a side of an output portion on the opposite side, FIG. 6. The feeding conveyor 20 which is shaped thin and long in width and length so that cloth to be fed is placed at the substantially central portion and both the right and left portions of the cloth droop.

Figure 4:
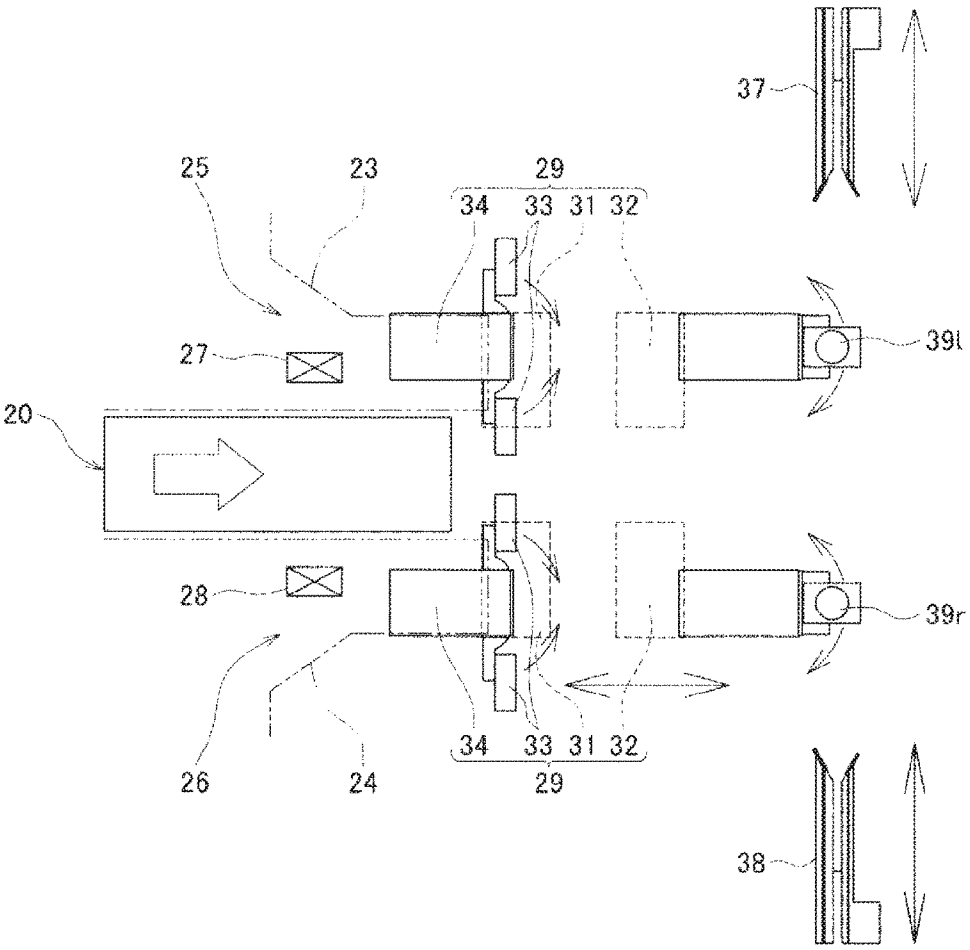
FIG. 4 is a plan view illustrating an example of a planar configuration of each component from a feeding conveyor to a spreading member.

In the feeding conveyor 20, guide members 23 and 24 which are provided in tapered shapes are arranged on both the right and left sides in order to gather and crumple both the right and left portions of cloth drooping on the right and left sides thereof in the central portion direction, FIG. 4. Therefore, crumpling paths 25 and 26 are formed on the right and left sides of the feeding conveyor 20 so as to allow both the right and left portions of cloth drooping from the central portion on both the right and left sides to enter and to be crumpled. A pair of sensors 27 and 28 on the right and left sides for checking the arrival of the right and left trailing end portions, Wl and Wr in FIG. 9 is arranged at the leading ends of the crumpling paths 25 and 26, and a pair of catch means 29 for catching the trailing end portion is provided farther ahead each on the right and left sides FIG. 4.

Figure 5:
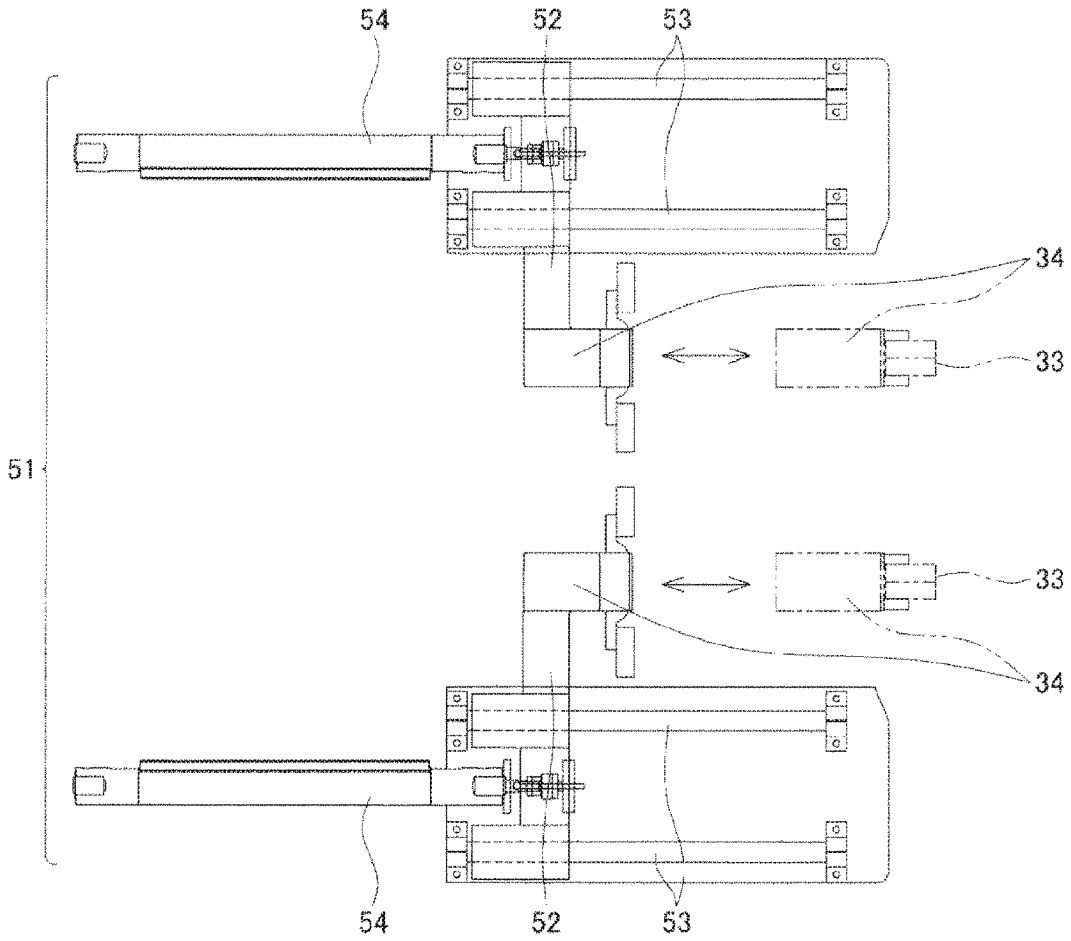
FIG. 5 is a plan view illustrating a movement mechanism of a catch member.

Each catch means 29 is formed to include a pair of rolls 31 and 32 at the front and rear which is provided to be able to come into contact with and to separate from each other so as to be able to pinch the trailing end portions Wl and Wr of cloth, and a catch member 33 which operates in the direction of the arrows in FIG. 4 from an open state to a closed state as illustrated for pinching and holding the right and left trailing end portions of cloth when the right and left trailing end portions approach the place between the pair of the rolls. The catch member 33 is open and closed by a drive unit 34 and is provided to be movable in a front and rear direction by a movement mechanism 51 as illustrated in FIG. 5. The movement mechanism 51 is configured to include a slider 52 having an arm for holding the drive unit 34, guide rails 53, and a cylinder of a drive unit 54. The movement mechanism 51 is installed on the right and left sides of the feeding conveyor 20.

Figure 6:
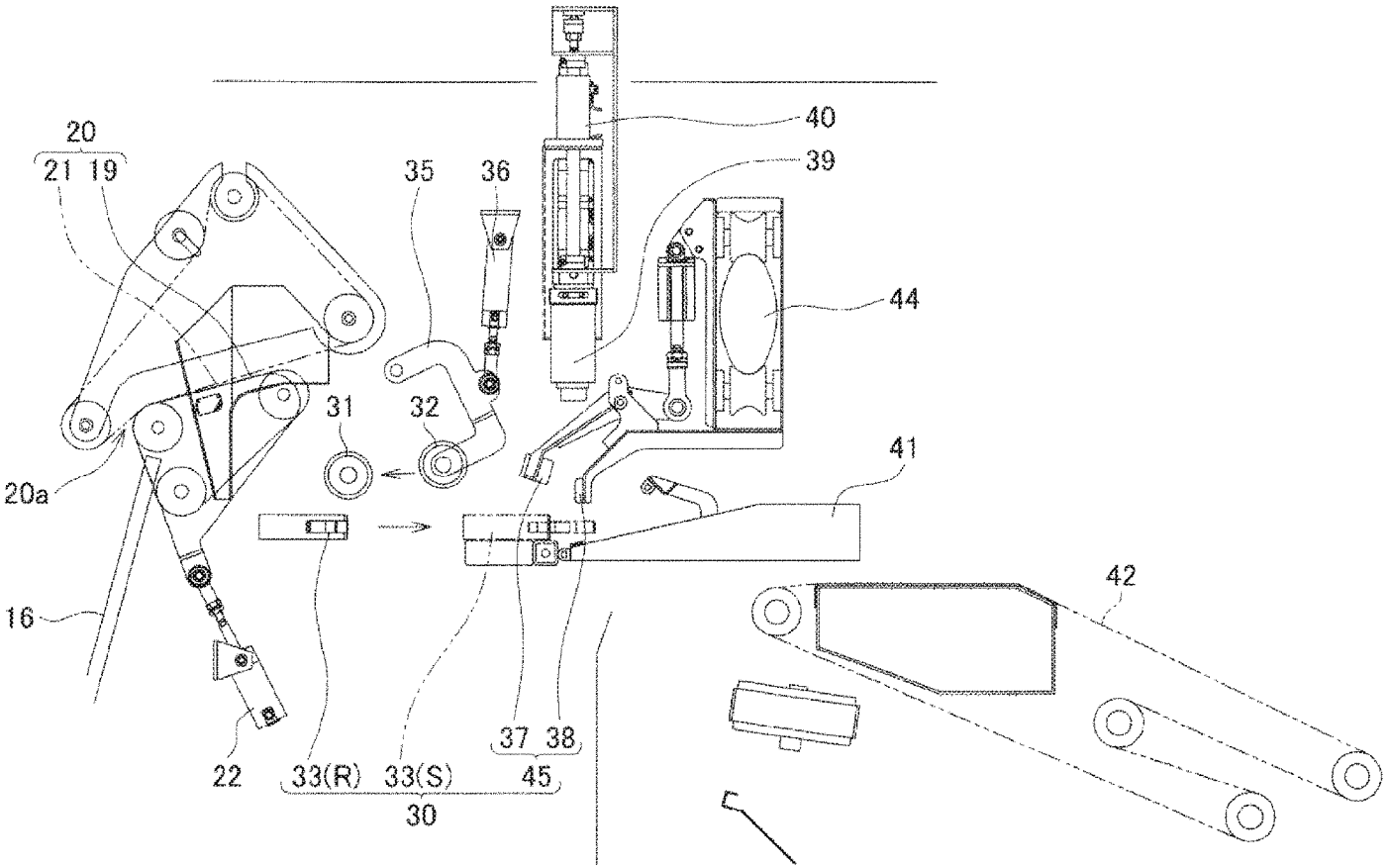
FIG. 6 is a side view illustrating an enlarged deposition section.

The catch means 29 in the embodiment is connected to one end of a crank 35 which is pivotally supported by a support shaft 35*a* on the feeder main body side, and operates by a drive unit 36 which is connected to the other end of the crank 35 and includes a linear cylinder, for example, refer to FIG. 6. The catch means 29 including the catch member 33 creates a deposition section 30 for moving cloth to a deposition member 41 while holding the right and left trailing end portions of the cloth together with spreading members 37 and 38 described below.

In FIG. 4, the catch member 33 holds the right and left trailing end portions of cloth which is caught by the catch means 29. The caught right and left trailing end portions of the cloth are in states of extending upward from below the pair of the rolls 31 and 32, and the catch member 33 holds the lower portion thereof. The catch member 33 is movable in the movement direction of cloth and is provided to correspond to each of the catch means 29. A movement range of the catch member 33 is from a reception position R where the right and left trailing end portions of cloth indicated by the solid line in FIG. 6 are received from the catch means 29, to a deposition position S where the right and left trailing end portions are deposited in the pair of the spreading members 37 and 38.

The spreading members 37 and 38 are provided to form one set of a pair for holding the right and left trailing end portions Wl and Wr of cloth. In other words, in an example of the embodiment in which depositing cloth to be carried is performed on the feeding conveyor 20, the pair of one set of the spreading members 37 and 38 is provided on both the right and left sides toward the front face of the feeder, refer to FIG. 4. The right and left trailing end portions of cloth are the trailing end portions when caught by the catch means 29, but the front and rear positions of cloth W are switched therebetween by being moved over to the spreading members 37 and 38 so as to be spread. Therefore, after being spread, the right and left trailing end portions are carried to the next process as the leading end portions of the cloth W.

A lifting means 39 is arranged in the deposition position S. The lifting means 39 in the embodiment utilizes a suction force. However, without being limited to the suction force, a picking up method can be applied with no technical problem. When the catch member 33 moves from the reception position R to the deposition position S, the lifting means 39 performs suctioning of the right and left trailing end portions of cloth, thereby lifting the right and left trailing end portions of cloth to positions higher than the spreading members 37 and 38. When the catch member 33 moves to the deposition position S, the spreading members 37 and 38 move to a standby position in a right and left direction, refer to FIG. 4. The lifting means 39 temporarily holds the right and left trailing end portions Wl and Wr extending upward from the catch means 29 on account of the suction force. In the meantime, the right and left trailing end portions Wl and Wr are held by the spreading members 37 and 38. Therefore, the lifting means 39 is provided in a vertically movable manner in order to take over the right and left trailing end portions. The reference numeral 40 denotes a drive unit for vertically moving the lifting means 39, and a known drive device such as the aforementioned linear cylinder is utilized.

The spreading members 37 and 38 can move in the right and left direction by a guide rail 44 which is installed in an upper portion at the rear portion of the feeder main body. The reference numeral 41 in FIG. 6 indicates a movable deposition member, which is provided to be movable in the front and rear direction by a drive mechanism (not illustrated) in order to receive the leading end portions of cloth which are placed on the top face of the catch member 33 at the deposition position S and to hand over the leading end portions to a carrying conveyor 42. The spreading members 37 and 38 configure a straightening unit 45 for pulling cloth held in the deposition section 30 to the right and left sides so as to achieve a straightened state. The straightening unit 45 is arranged at two places on the right and left sides in the following stage of the feeding conveyor 20, and configures the cloth standby section 14. The reference numeral 43 indicates a suctioning box which performs suctioning of fed cloth and straightens the cloth so as to be in its original shape.

Figure 7:
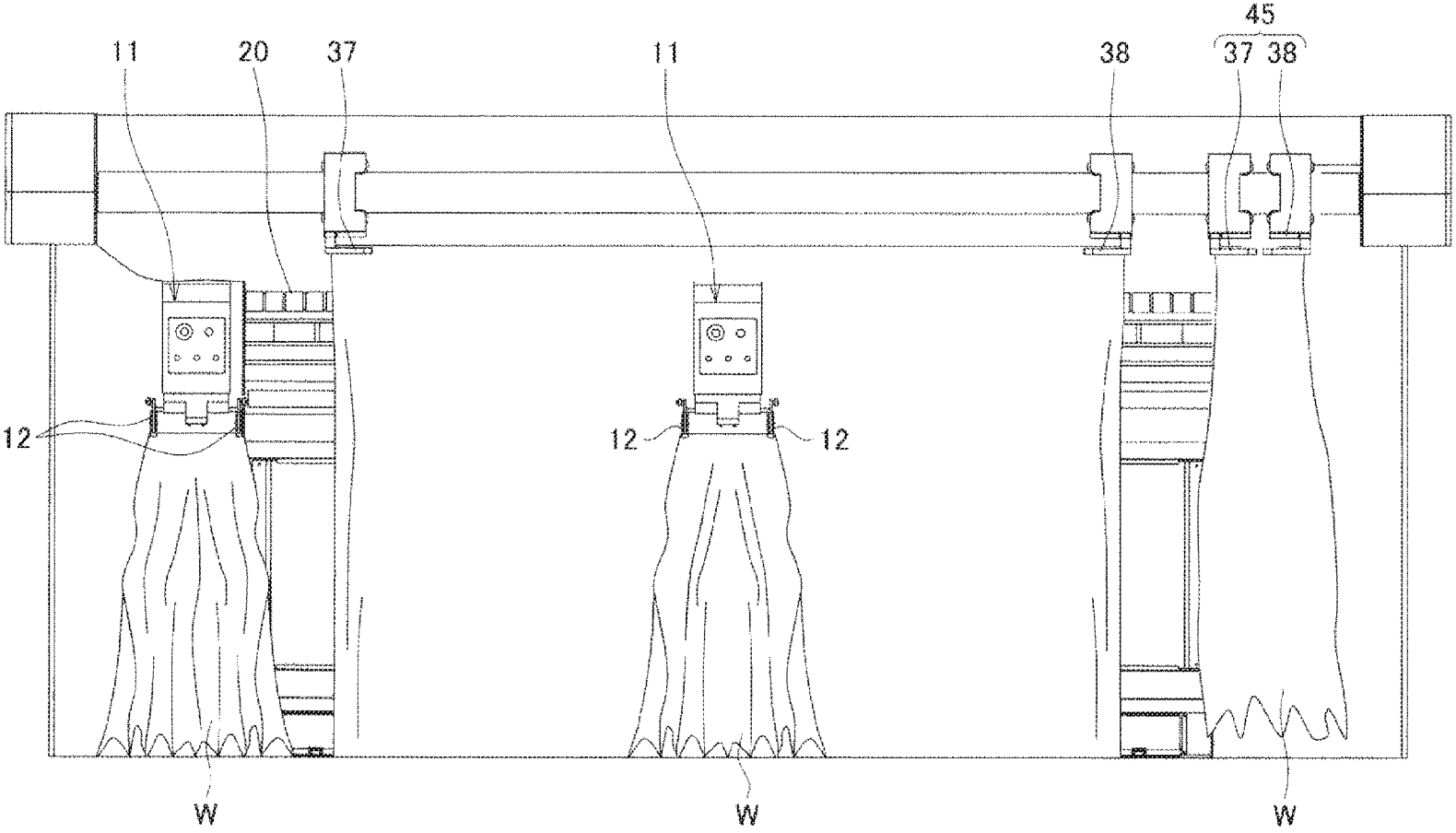
FIG. 7 is a front view illustrating a process of feeding cloth according to the present invention.
Figure 8:
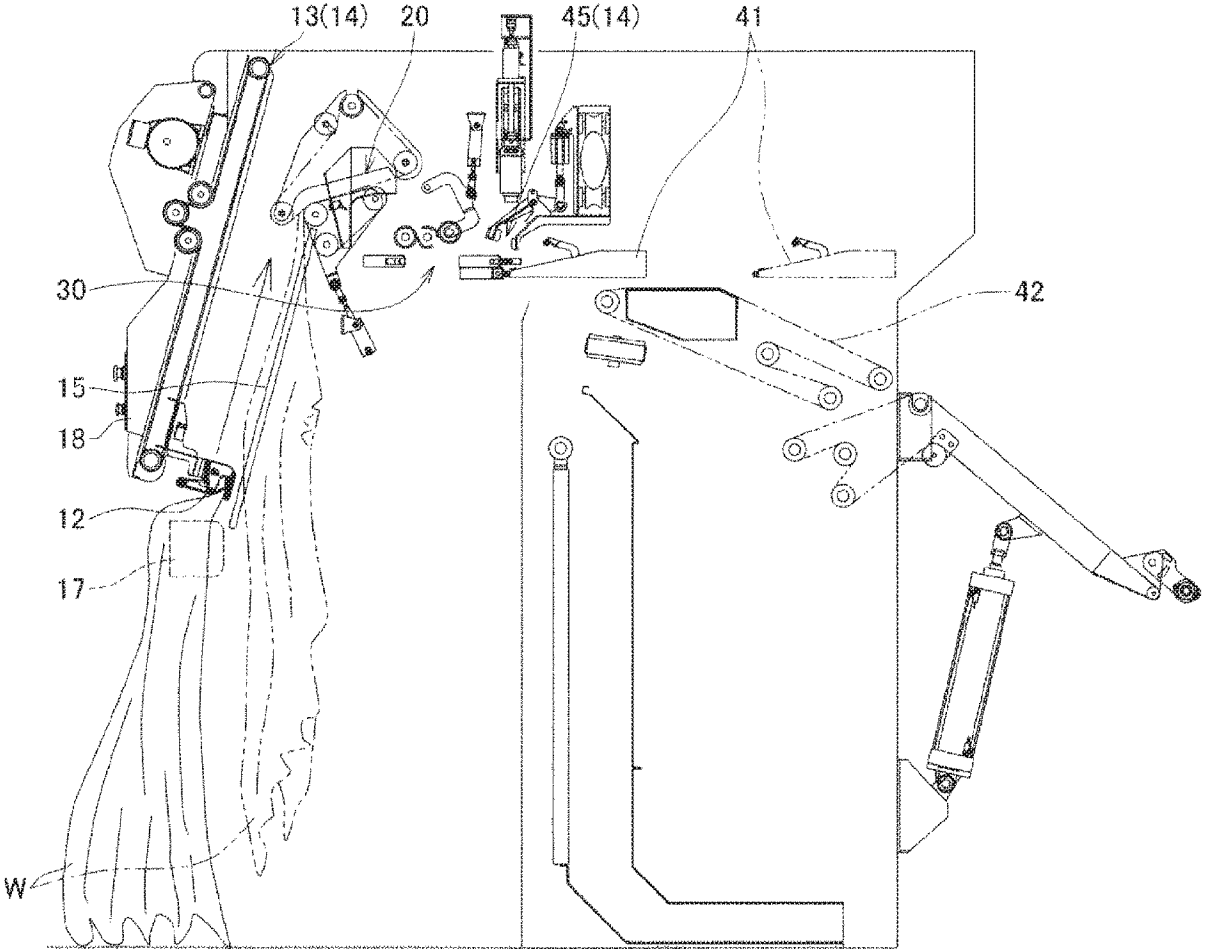
FIG. 8 is a side view illustrating a process of spreading cloth.

In the device of the present invention having such a configuration, while the cloth W in the forefront is in a spread state in the spreading members 37 and 38, a worker can attach the cloth W to the clamps 32 at three places, refer to FIG. 7. In the feeder of the present invention, a portion of the cloth W attached to the pair of the clamps 12 and 12 and is caused to be straightened. In such a state, the cloth W is carried while being placed at the substantially central portion, and both the right and left portions drooping on the right and left sides of the feeding conveyor 20 are gathered and crumpled in a central portion direction by the guide members 23 and 24. As a result, the right and left trailing end portions Wl and Wr, refer to FIG. 9 of cloth pass through the sensors 27, 28 last of all, are detected, and are held by the catch means 29. Moreover, the lifting means 39 moves downward, approaches the right and left trailing end portions Wl and Wr of the cloth W, and performs suctioning of the right and left trailing end portions Wl and Wr, thereby lifting the right and left trailing end portions Wl and Wr to positions higher than the spreading members 37 and 38.

As the spreading members 37 and 38 approach the right and left trailing end portions Wl and Wr of cloth at a position higher than the catch member 33 which is at the deposition position S, thereby holding the right and left trailing end portions Wl and Wr. In this manner, the first stage of transferring the cloth W is completed, refer to FIG. 9A. Accordingly, the trailing end portions Wl and Wr of cloth may be referred to as the leading end portions of the cloth thereafter. Subsequently, the spreading members 37 and 38 holding the right and left trailing end portions Wl and Wr of the cloth W spread the cloth to the right and left sides while moving to the central portion of the feeder main body. In other words, the front and rear positions of the cloth W are switched therebetween, and a side portion E turns into the leading end side while maintaining a straight line shape and is carried to the next process. As cloth is fed at working speed by a general worker in the above-described manner, feeding proceeds at the following stage without congestion.

In an automatic feeder of the related art, a supplying amount of cloth depends on only the working speed of a worker, and thus, it is not possible that the working speed exceeds the feeding speed of the automatic feeder. However, according to the present invention, one piece of the cloth W is fed into the process in accordance with the above-described feeding processing at one place among the three places of the clamps 12 and the cloth W is not directly placed on the feeding conveyor, but the cloth passes through the movement mechanism 13 first. Accordingly, the movement mechanism 13 functions as the cloth standby section 14 at the preceding stage of the feeding conveyor 20. While the first cloth W is in the feeding process as described above, one for each, that is, two pieces of the cloth W in total are in standby states in the clamps 12 at the two remaining places, and thus, the two pieces of the cloth W is also in buffering states. Therefore, it is possible to adjust the number of the cloth pieces to be accumulated while the cloth is slowly carried through the process.

Figure 9B:
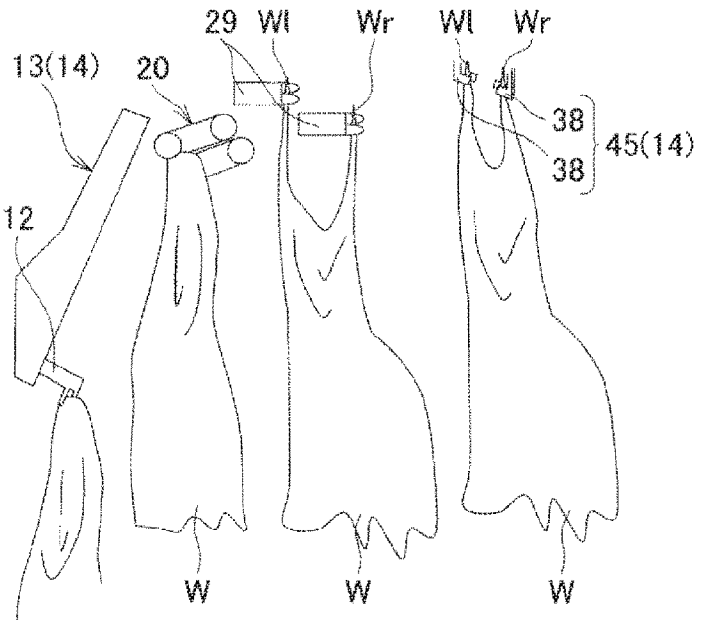
FIGS. 9A and 9B illustrate the process according to the present invention.
Figure 9A:
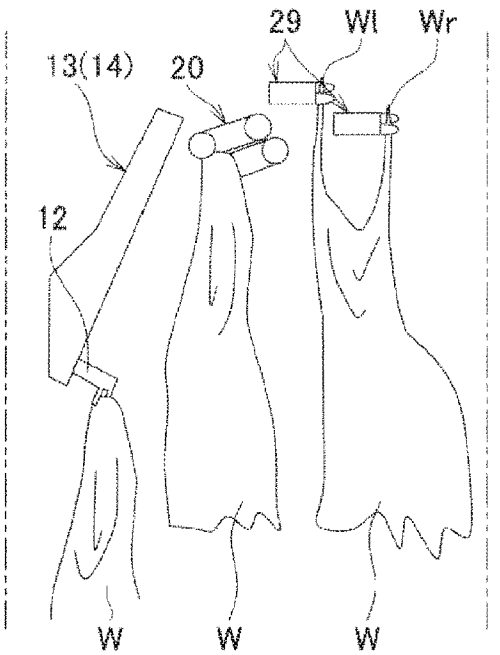
Figure 9C:
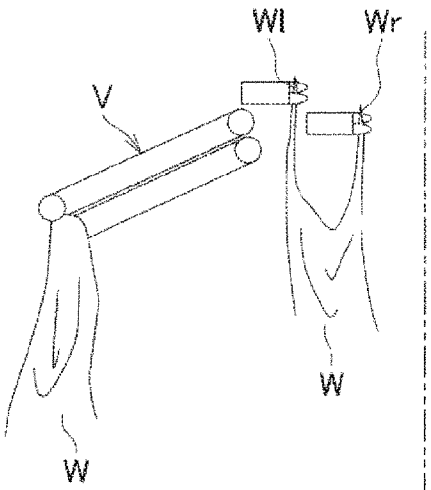
Fig. 9C PRIOR ART
FIG. 9C is a view illustrating a process performed by a cloth spreading apparatus in the related art.

FIGS. 9A, 9B and 9C illustrates a state where the right and left trailing end portions Wl and Wr of cloth W are held by the catch means 29 and the like. FIG. 9A illustrates a state passing through three processes such as a process in which the cloth W is held by the clamp 12 in the device of the present invention, a process in which detection of the right and left trailing end portions is performed while being carried in the feeding conveyor 20, and a process in which the right and left trailing end portions are held by the catch means 29. When comparing the process to the process in the related art as illustrated in FIG. 9C, it is evident that a temporary standby time or timing therefor is gained as long as the process in which the cloth W is held by the clamp 12 that is the cloth standby section at the preceding stage of the feeding conveyor 20. In addition, it is also understood that the feeding conveyor 20 can be shorter than a conveyor V in the related art.

FIG. 9B illustrates the buffering state in the device of the present invention in which a process of spreading cloth performed by the straightening unit 45 formed with the spreading members 37 and 38 is added to that in FIG. 9A. In FIG. 9B, since a straightening process performed by the straightening unit 45 is added, the number of processes that the cloth must pass through is double that of the processes in the related art, when simply comparing the numbers of processes therebetween. Moreover, since a pair of the straightening units 45 is arranged on the right and left sides with respect to the deposition section 30 at one place, it is found out that a temporary standby time or timing for cloth can be further gained.

Figure 10:
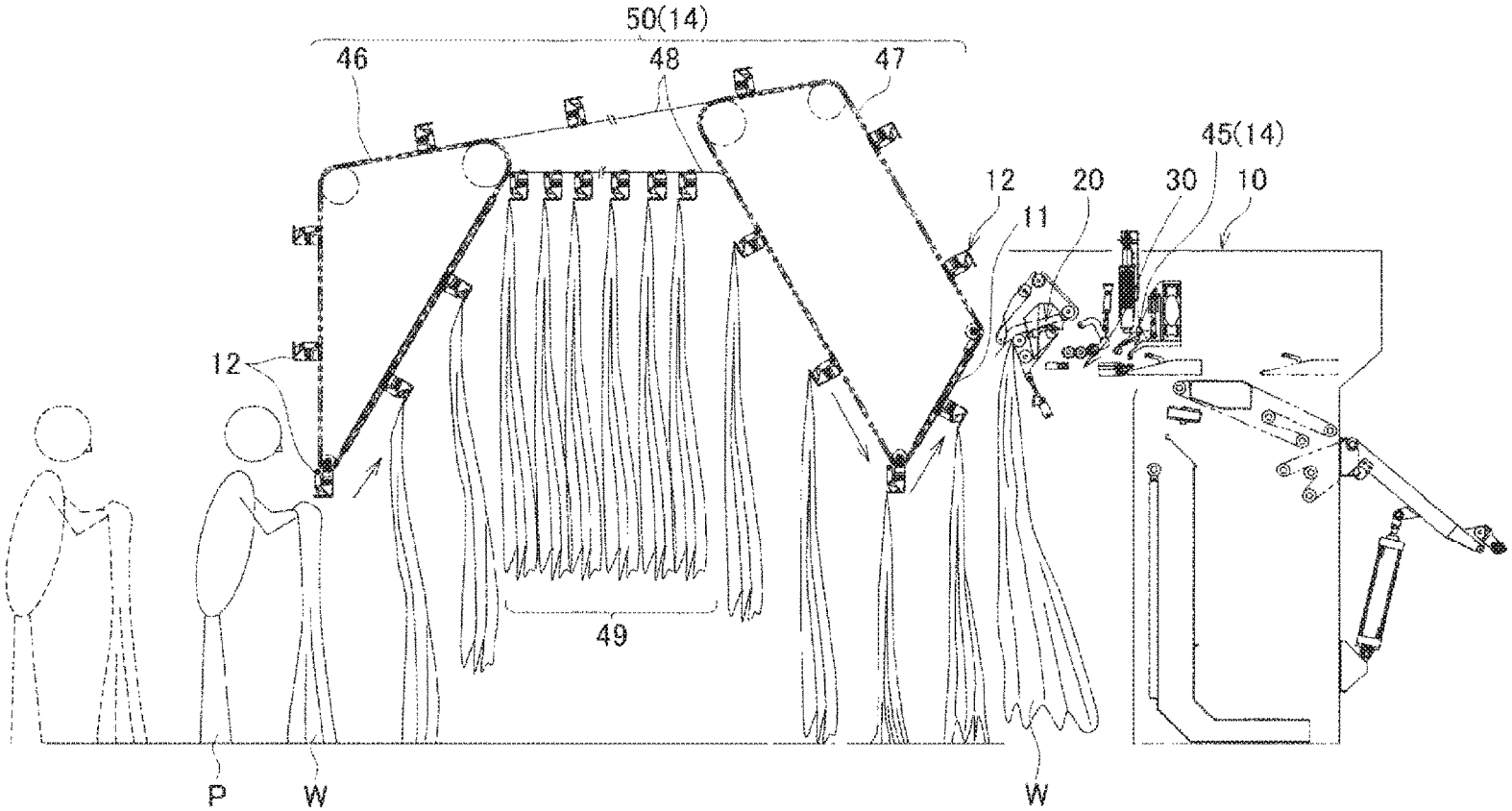
FIG. 10 is a side view illustrating a developed embodiment of a buffering device according to the present invention.

Moreover, a further embodiment of the buffering device according to the present invention will be described with reference to FIG. 10. In FIG. 10, the cloth standby section 14 includes a circulation carrying device 50 together with a dedicated portion 49 for buffering and is provided with multiple clamps 12 which move along a circulation route so as to cause the cloth W to be held at the substantially central portion between the right and left sides in the movement direction. The circulation carrying device 50 includes a plurality of circulation conveyors 46 and 47, and a conveyor belt 48 is wound around therebetween. The multiple clamps 12 are attached to the conveyor belt 48.

Accordingly, a worker P can concentrate on only attaching the cloth W to the clamp 12 in the circulation carrying device 50, and the attaching is performed independently of an operation of an automatic feeder 10. The last conveyor line in the circulation carrying device 50 coincides with the conveyor in the movement mechanism 13 as illustrated in FIG. 2 and the like, and the content in the dedicated portion 49 for buffering between the circulation conveyors 46 and 47 can be arbitrarily set, thereby leading to the rapidly improved standby performance of the movement mechanism 13.

The invention claimed is:

1. A buffering device in an automatic cloth feeder comprising:

a cloth supply section that can supply a quantity of cloth exceeding a processing quantity of feeding so as to proceed with feeding in the automatic cloth feeder without congestion in the automatic cloth feeder performing a process in which the cloth is introduced to a feeding conveyor at a substantially central portion in a carrying direction, right and left trailing end portions of the cloth are crumpled from the right and left sides by guide members, the cloth is held in a deposition section, and the cloth is fed into the process, wherein a cloth standby section in which the cloth to be carried stands by temporarily is set at a preceding stage of the feeding conveyor and at a following stage thereof; and wherein a straightening unit is provided at the following stage of the feeding conveyor in order to cause the cloth held in the deposition section to be in a straightened state by pulling the cloth to the right and left sides, and the straightening unit is arranged at a plurality of places so as to be the cloth standby section.

2. The buffering device in an automatic cloth feeder according to claim 1, wherein the cloth supply section which is equipped with a clamp holding cloth at a substantially central portion between the right and left sides in a movement direction and moving upward to the feeding conveyor from below is arranged at the preceding stage of the feeding conveyor as the cloth standby section.

3. A buffering device in an automatic cloth feeder comprising:

a cloth supply section that can supply a quantity of cloth exceeding a processing quantity of feeding so as to proceed with feeding in the automatic cloth feeder without congestion in the automatic cloth feeder performing a process in which the cloth is introduced to a feeding conveyor at a substantially central portion in a carrying direction, right and left trailing end portions of the cloth are crumpled from the right and left sides by guide members, the cloth is held in a deposition section, and the cloth is fed into the process, wherein a cloth standby section in which the cloth to be carried stands by temporarily is set at a preceding stage of the feeding conveyor or at a following stage thereof, A buffering device in an automatic cloth feeder comprising:

a cloth supply section that can supply a quantity of cloth exceeding a processing quantity of feeding so as to proceed with feeding in the automatic cloth feeder without congestion in the automatic cloth feeder performing a process in which the cloth is introduced to a feeding conveyor at a substantially central portion in a carrying direction, right and left trailing end portions of the cloth are crumpled from the right and left sides by guide members, the cloth is held in a deposition section, and the cloth is fed into the process, wherein a cloth standby section in which the cloth to be carried stands by temporarily is set at a preceding stage of the feeding conveyor and at a following stage thereof, and wherein the cloth standby section includes a circulation carrying device which is a dedicated portion for buffering, is equipped with multiple clamps which hold the cloth along a circulation route of the circulation carrying device, and has a configuration in which the cloth is attached to the clamp at the substantially central portion between the right and left sides in the movement direction.

* * * * *